US011896146B2

(12) United States Patent
Sherretts et al.

(10) Patent No.: US 11,896,146 B2
(45) Date of Patent: Feb. 13, 2024

(54) RETAIL PRODUCT DISPENSING SYSTEM

(71) Applicant: SENNCO SOLUTIONS INC., Plainfield, IL (US)

(72) Inventors: Jeffrey Sherretts, North Babylon, NY (US); Daniel L. Horvath, Plainfield, IL (US); Ryan R. G'Fellers, Oswego, IL (US)

(73) Assignee: SENNCO SOLUTIONS INC., Plainfield, IL (US)

( * ) Notice: Subject to any disclaimer, the term of this patent is extended or adjusted under 35 U.S.C. 154(b) by 38 days.

(21) Appl. No.: 17/695,467

(22) Filed: Mar. 15, 2022

(65) Prior Publication Data

US 2022/0287479 A1 Sep. 15, 2022

Related U.S. Application Data

(60) Provisional application No. 63/161,257, filed on Mar. 15, 2021.

(51) Int. Cl.
*A47F 3/00* (2006.01)
*A47F 3/02* (2006.01)

(52) U.S. Cl.
CPC ..... *A47F 3/002* (2013.01); *A47F 3/02* (2013.01)

(58) Field of Classification Search
CPC .. A47F 1/125; A47F 3/002; A47F 3/02; G07F 11/42
See application file for complete search history.

(56) References Cited

U.S. PATENT DOCUMENTS 2,656,029 A 10/1953 Spero et al.
2,719,651 A * 10/1955 Gabrielsen ..... G07F 11/42 194/219
4,027,415 A * 6/1977 Stoner ..... F41A 9/83 42/50
4,200,201 A * 4/1980 Collins ..... G07F 11/38 221/129
4,976,376 A * 12/1990 Williams ..... G07F 17/32 221/24
5,337,876 A * 8/1994 McGee ..... G07F 11/42 221/75

(Continued)

OTHER PUBLICATIONS

ISA/US, English language verison of the International Search Report, Form PCT/ISA/210, for International Application PCT/US22/20413, dated Mar. 15, 2022 (03 pages).

(Continued)

*Primary Examiner* — Gene O Crawford
*Assistant Examiner* — Kelvin L Randall, Jr.
(74) *Attorney, Agent, or Firm* — Pauley Erickson & Swanson

(57) ABSTRACT

A product dispensing system includes a housing having lockable access, a forward viewing window and a lower output tray. Two or more trays are positioned within the housing, each tray of the trays accommodating a plurality of products, wherein each tray includes a self-contained motor and track configured to move the products responsive to a user action. The system additionally includes a selector for moving an indicator laterally between the two or more trays and a knob spaced apart from the selector for activating the motor to move the products forward and drop a single product into the output tray.

20 Claims, 8 Drawing Sheets

(56) References Cited

U.S. PATENT DOCUMENTS

| | | | | |
|---|---|---|---|---|
| 5,690,251 | A * | 11/1997 | Wade | G07F 9/02 221/277 |
| 8,800,811 | B2 | 8/2014 | Sherretts et al. | |
| 2002/0017531 | A1* | 2/2002 | Adriani | G07F 11/42 221/124 |
| 2008/0245811 | A1* | 10/2008 | Colelli | G07F 11/06 221/90 |
| 2011/0015781 | A1* | 1/2011 | Vardaro | B65D 83/0418 700/231 |
| 2011/0036789 | A1* | 2/2011 | Richardson | A47F 5/0861 211/1.57 |
| 2011/0220597 | A1* | 9/2011 | Sherretts | A47F 1/126 211/59.3 |

OTHER PUBLICATIONS

ISA/US, Form PCT/ISA/237, Written Opinion of the International Searching Authority, for International Application PCT/US22/20413, dated Mar. 15, 2022 (06 pages).

* cited by examiner

RETAIL PRODUCT DISPENSING SYSTEM

CROSS REFERENCE TO RELATED APPLICATIONS

This application claims the benefit of U.S. Provisional Patent Application, Ser. No. 63/161,257, filed on 15 Mar. 2021. The Provisional Application is incorporated by reference herein in its entirety and is made a part hereof, including but not limited to those portions which specifically appear hereinafter.

BACKGROUND OF THE INVENTION

Field of the Invention

The invention is related to security devices for dispensing product inventory on a per unit basis.

Description of the Prior Art

Vendors, retailers and/or wholesalers often display small, high-value products to customers at, for example, a retail store and/or a sales facility. Such high-value products may include pre-packaged products, such as, for example, over-the-counter medication, razor blade cartridges, batteries, etc. Such high-value products have traditionally been displayed in or on a fixture, such as, for example, a cabinet, a table, a wall, a column, a shelf, and/or the like. Retailers' efforts at theft reduction include placing such products within a locked cabinet that must be accessed by store personnel for distribution to customers. However, such an approach discourages customers from buying thereby reducing sales. Product security and the customer's ability to hold and handle the product are often in tension with each other, and thus there is a continuing need to provide improved systems to improve the customer experience.

SUMMARY OF THE INVENTION

The invention includes a plurality of refillable product trays within a housing. A selector is used to move a pointer to a desired tray of products and then a knob is actuated to dispense desired product from the tray and into an output tray. In a preferred embodiment, the entire system is self-winding by virtue of filling and maintaining a stock of product and therefore does not require power for operation. In addition, the configuration of the subject system requires user input and intervention to release the desired product in an intentionally two-hands-on and time intensive manner such as to minimize the potential for shelf "sweeping" or bulk loss or theft of product.

DETAILED DESCRIPTION

FIGS. 1-16 show various preferred embodiments of a product dispensing system 10 and various components thereof. The invention provides a system for dispensing product to a consumer in a retail environment on a per unit basis. The system is intended to reduce loss due to theft of generally high margin, small-sized products by minimizing the ability of a potential thief to remove multiple products at once from store shelves.

Figure 1:
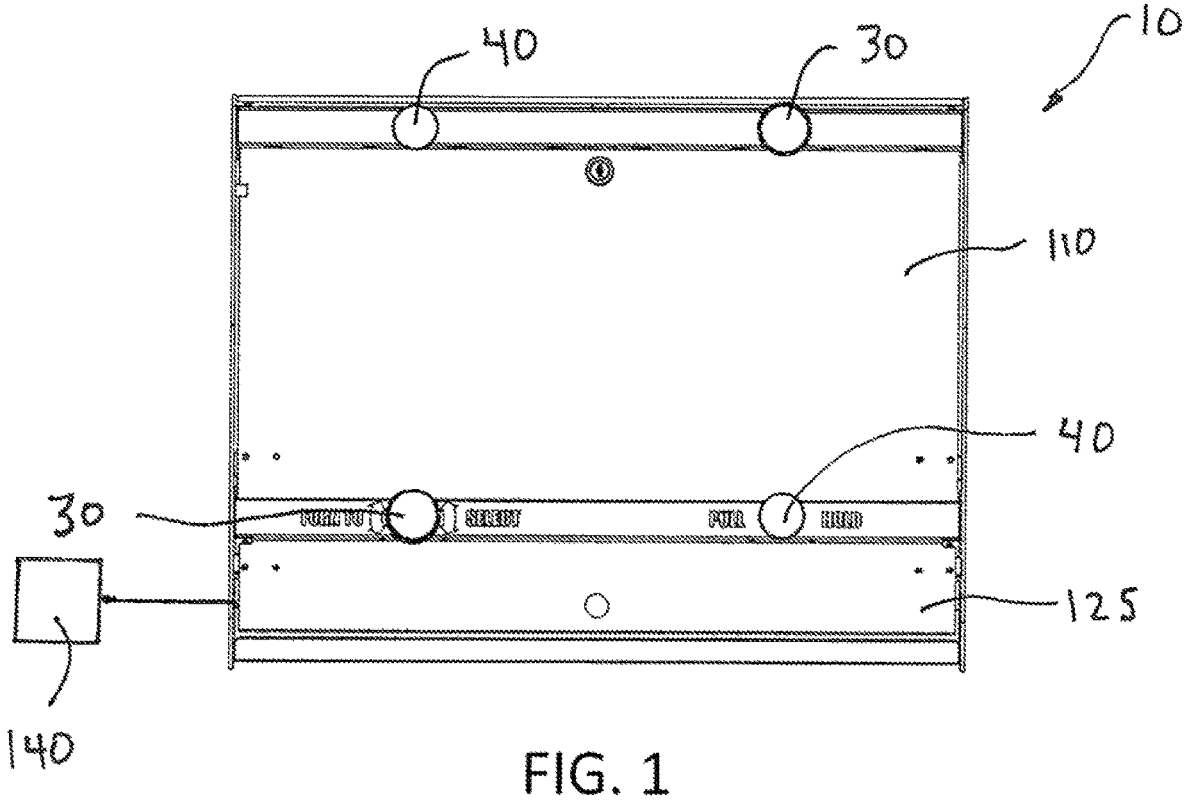
FIG. 1 shows a front view of a product dispensing system according to one embodiment of the invention.
Figure 2:
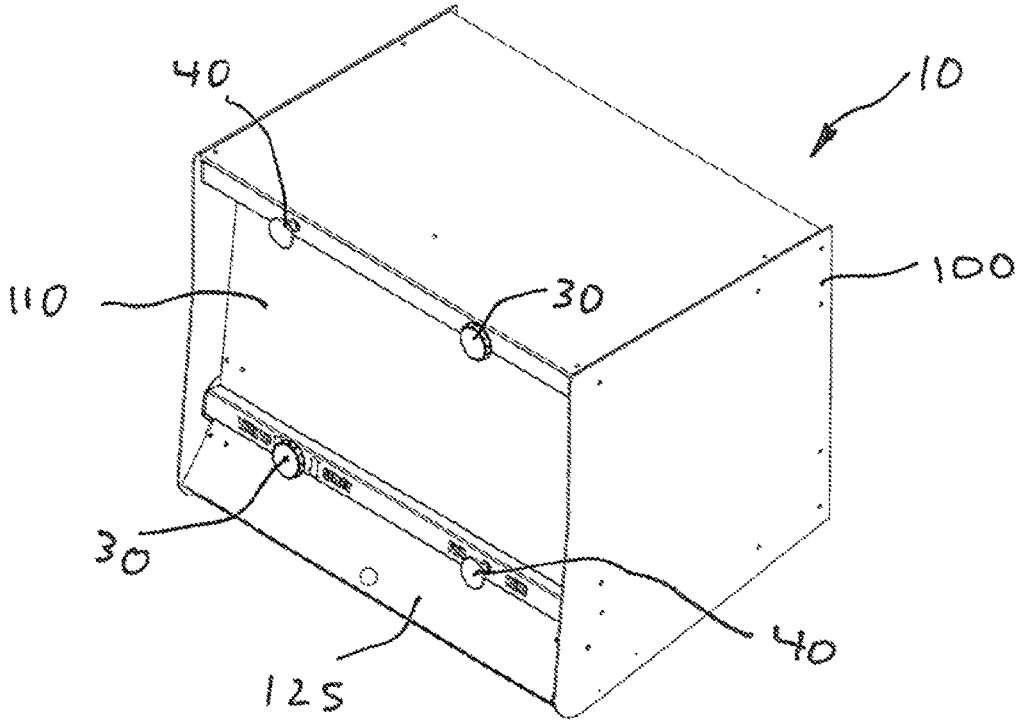
FIG. 2 shows a front perspective view of the product dispensing system shown in FIG. 1.

FIGS. 1 and 2 show a product dispensing system 10 including a housing 100 that encloses product for dispensing to a customer. As used herein, a product may be a retail product such as over-the-counter medication, razor blade cartridges, candy, batteries, cosmetics, tools, accessories, electronics, hair care products, and/or any other relatively small, high value product that a retail consumer may desire for purchase. Typical demand for such products would be for one or two products at a time in a retail setting. In addition, the product dispensing system 10 according to this invention may be used in non-retail environments such as factory floors or workspaces and may dispense non-retail products such as safety glasses, ear plugs, computer peripherals, snacks and/or other products that a business owner may want to make available to employees but also discourage the employee from taking multiple products simultaneously. As such, the term product may be directed at virtually any manufactured good of a size and nature to which a business owner may want to limit high volume access.

The housing 100 preferably includes lockable access for restricting access to an interior of the housing 100 to only those store personnel or employees with a key or other access method. The housing 100 is preferably a rigid steel frame with simplified assembly, such as toolless interlocking sidewalls, base and access door(s). The lockable access may be a transparent and lockable upper door 110 that enables a customer to view what is available on the store shelf. According to one embodiment a forward viewing window is positioned in a forward-facing position outward from a store shelf or fixture. This window may comprise polycarbonate, tempered glass and/or other desired material that is break- and scratch-resistant, transparent and relatively lightweight.

Alternatively, a cage or wire screen may be used to cover and protect the front of the housing 100.

In addition, the housing may include a clear security flap 125 over the output tray 120. In this way, a user can see that the product has been dispensed into the output tray 120.

Figure 3:
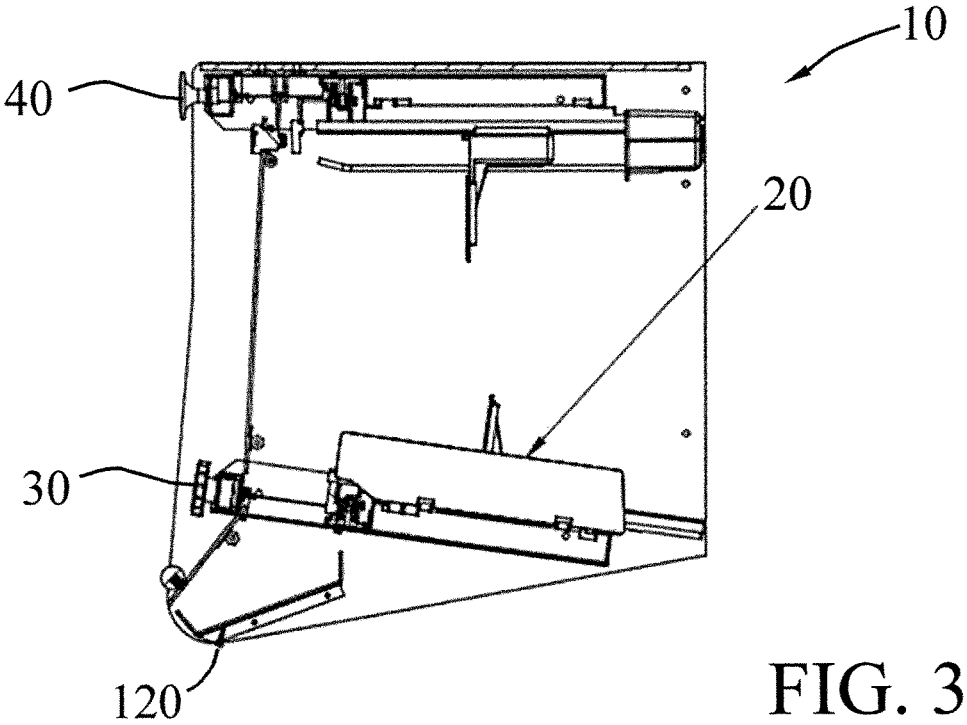
FIG. 3 shows a side cross-sectional view of the product dispensing system shown in FIG. 1.
Figure 4:
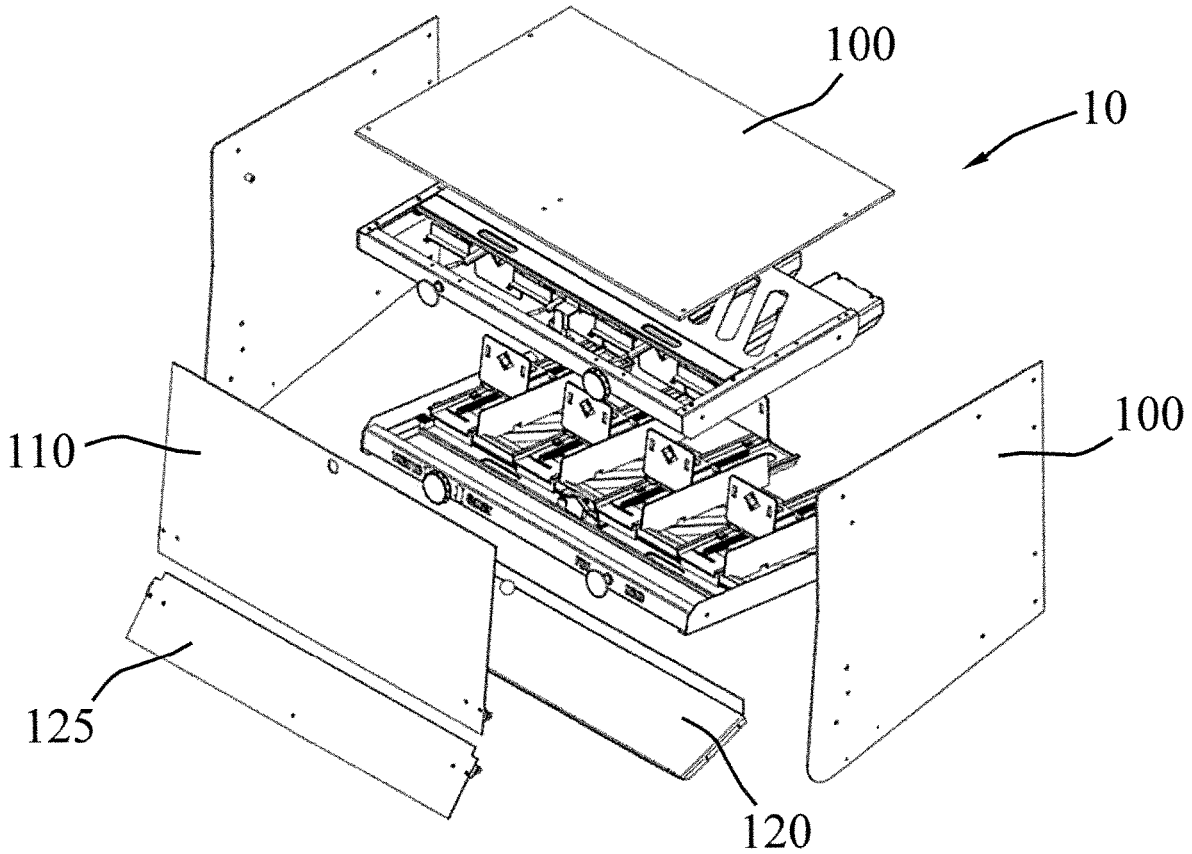
FIG. 4 shows an exploded view of the product dispensing system shown in FIG. 1.

As shown in the cross-section in FIG. 3 and the exploded view in FIG. 4, the housing 100 preferably accommodates two or more trays 20 positioned within the housing 100. Each tray 20 preferably accommodates a plurality of products and includes a motor 70 and a pusher 60 as described in more detail below. The product dispensing system 10 as shown may include one or more levels of products wherein two or more trays 30 are arranged along each of the one or more levels of products. As shown in one embodiment in FIGS. 3 and 4, the system 10 may include an upper level and a lower level wherein product on the upper level hangs from a peghook and product on the lower level rests on a tray. However, these arrangements may be mixed and matched across multiple levels comprising all peghooks or all trays depending on the application. It is preferable for product that is placed on a tray and not on a peghook to be slightly inclined rearward such that product is retained within the system 10 by virtue of the incline, as shown in FIG. 3.

FIG. 4 shows an exploded view of the product dispensing system 10 that shows multiple trays 20 on which products may be inventoried. The trays 20 may be arrayed within the housing 100 and restocked through the upper door 110 by a store employee. Each tray 20 preferably includes a line of products for dispensing on a per unit basis from the product dispensing system 10.

The product dispensing system 10 preferably further includes a selector 30 used to direct an arrow or similar indicator 35 to a desired product. The selector 30 as shown in the figures is preferably a turnable knob that may be knurled or otherwise textured to visually suggest rotation. In addition, the housing 100 may be marked with instructions regarding rotation of the selector 30. The selector 30 may then be rotated or otherwise actuated to move the indicator 35 laterally between the two or more trays 30 of products across one level of the system 10.

A knob 40 is preferably spaced apart from the selector 30 and is configured to activate the motor 70 on the tray 30 to move the products forward and drop a single product into the output tray 120. The separate knob 40 may be rotated or pulled to dispense the product, preferably by actuating the knob 40 for a duration of time. As shown, selectors 30 and knobs 40 may be separately positioned for each row of trays 20 within a housing 100—in this case two rows of trays 20 across a top level and a bottom level of the product dispensing system 10. However, additional rows of trays 20 may be included using a corresponding number of separate selectors 30 and knobs 40. By separating the respective selector 30 and the knob 40, a customer must generally use two hands to operate the product dispensing system 10 thereby increasing the time required to operate and dispense and thereby reduce the potential opportunity to quickly remove numerous products from the product dispensing system 10 for potential theft.

The product dispensing system 10 according to this invention may further include an upper and lower level wherein each level includes a dedicated selector 30 and knob 40 for dispensing product to the output tray 120. According to one embodiment of the invention, the selector 30 and the knob 40 are in a reverse position on an upper level from a lower level. For example, the selector 30 is positioned on a left side of the housing 100 for the lower level and on the right side of the housing for the upper level. This arrangement both minimizes confusion for the user as it is clear which level is being selected and continues to obligate the user to use both hands to operate the product dispensing system 10 thereby minimizing the ability to draw multiple products out of the system 10 simultaneously.

FIGS. 5-7, 12 and 16 best show an arrangement that is operatively connected with the selector 30. As described, the selector 30 is preferably operatively connected with respect to a lifter carriage 55. The lifter carriage 55, the selector 30 and the knob 40 are preferably all arranged along a cable 50 wherein, once the knob 40 is actuated, for instance by twisting, the cable 50 actuates a respective tray 20 through the lifter carriage 55 to dispense the single product. For instance, in one preferred embodiment, the knob 40 is configured to rotate and thereby tighten the cable 50, raise up the lifter carriage 55, and actuate the respective tray 20 through an integrated motor 70 (described below). As such, the lifter carriage 55 is preferably affixed to the cable 50 and moves as the selector 30 is rotated to move the cable 50 and thus the lifter carriage 55 across a linear path in front of respective trays 20 of product.

Figure 5:
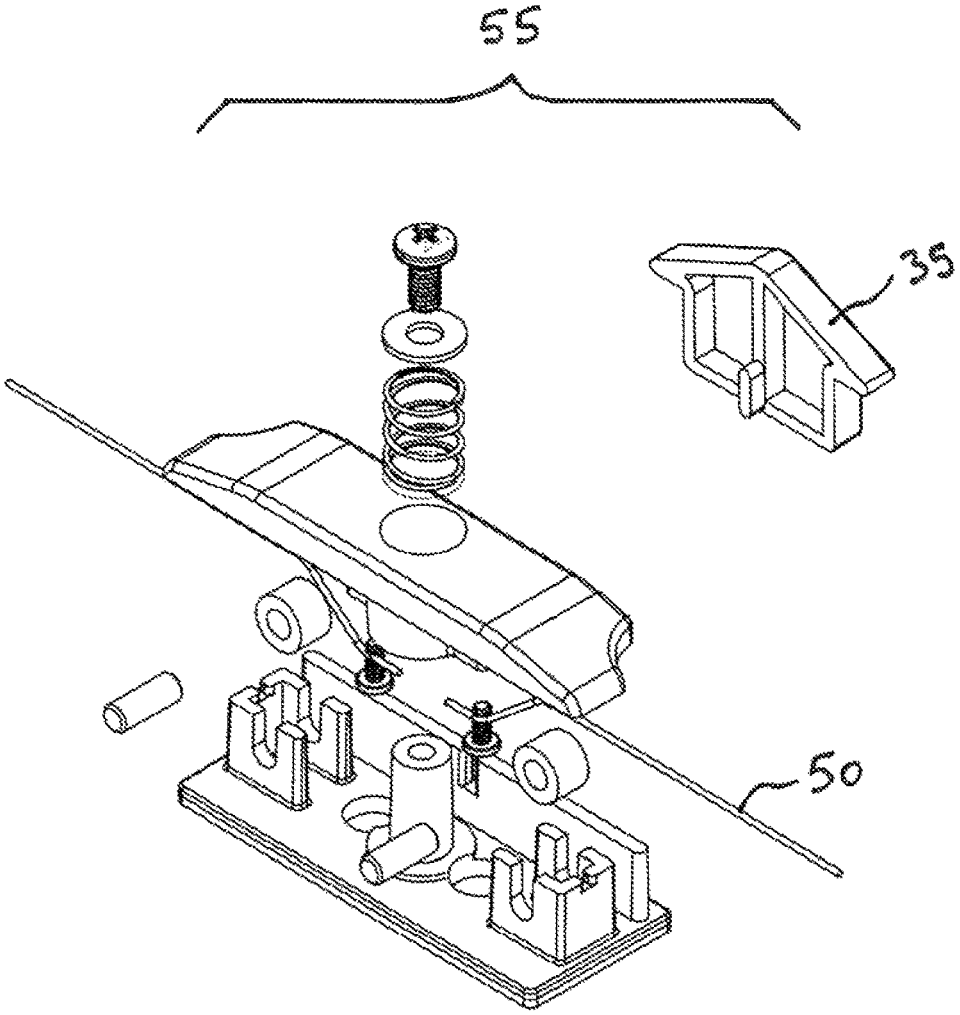
FIG. 5 shows an exploded front perspective view of a selector assembly according to one embodiment of the invention.
Figure 6:
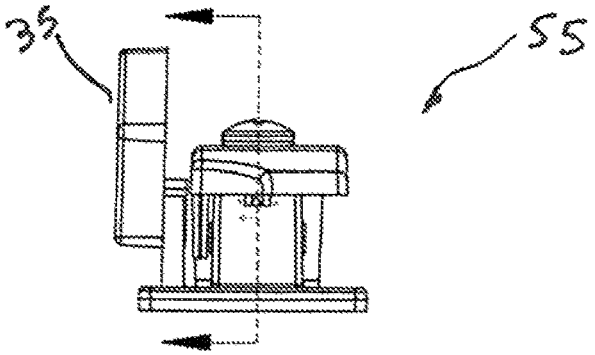
FIG. 6 shows a side view of the selector assembly shown in FIG. 5.
Figure 7:
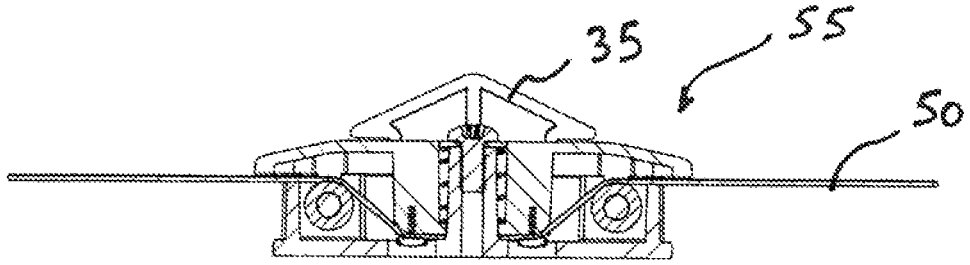
FIG. 7 shows a top cross-sectional view of the selector assembly shown in FIG. 6.

FIGS. 5-7 shows the lifter carriage 55 according to one preferred embodiment. The lifter carriage preferably includes a pointer 35 or similar designator for showing which product and which tray 20 is intended for dispensing within the system. In addition, two ends of a cable 50 are preferably attached to the selector 30 to enable a user to turn the selector 30 left or right to direct the pointer 35 to the desired tray 20 for dispensing. The cable 50, described in more detail below, preferably extends around a perimeter within the product dispensing system and is fitted around two or more pulleys that enable movement of the selector 30 within the housing 100.

As described, the selector 30 is operable to move the lifter carriage 55 and thus the pointer/indicator 35 with the cable 50 to position the lifter carriage 55 in front of a desired tray 20. Each tray 20 is preferably equipped with a pusher 60 and a self-contained motor 70 and track 80 configured to move the products responsive to a user action. The motor is preferably a spring-wound motor such as a movement used in a music box. The motor 70 preferably includes a drive wheel 75 that engages with the track 80 in a rack and pinion arrangement to move the pusher 60 relative to the tray 20. In one embodiment, the motor 70 is preferably a self-winding motor that is operatively connected to the pusher 60 and the track 80 such that an action of restocking product in the tray 20 moves the pusher 60 relative to the track 80 and thereby winds the motor 70. When actuated by the lifter carriage 55, the motor 70 operates to move the pusher 60 forward and thus drop a product off the tray 20 and into the output tray 120.

Figure 8:
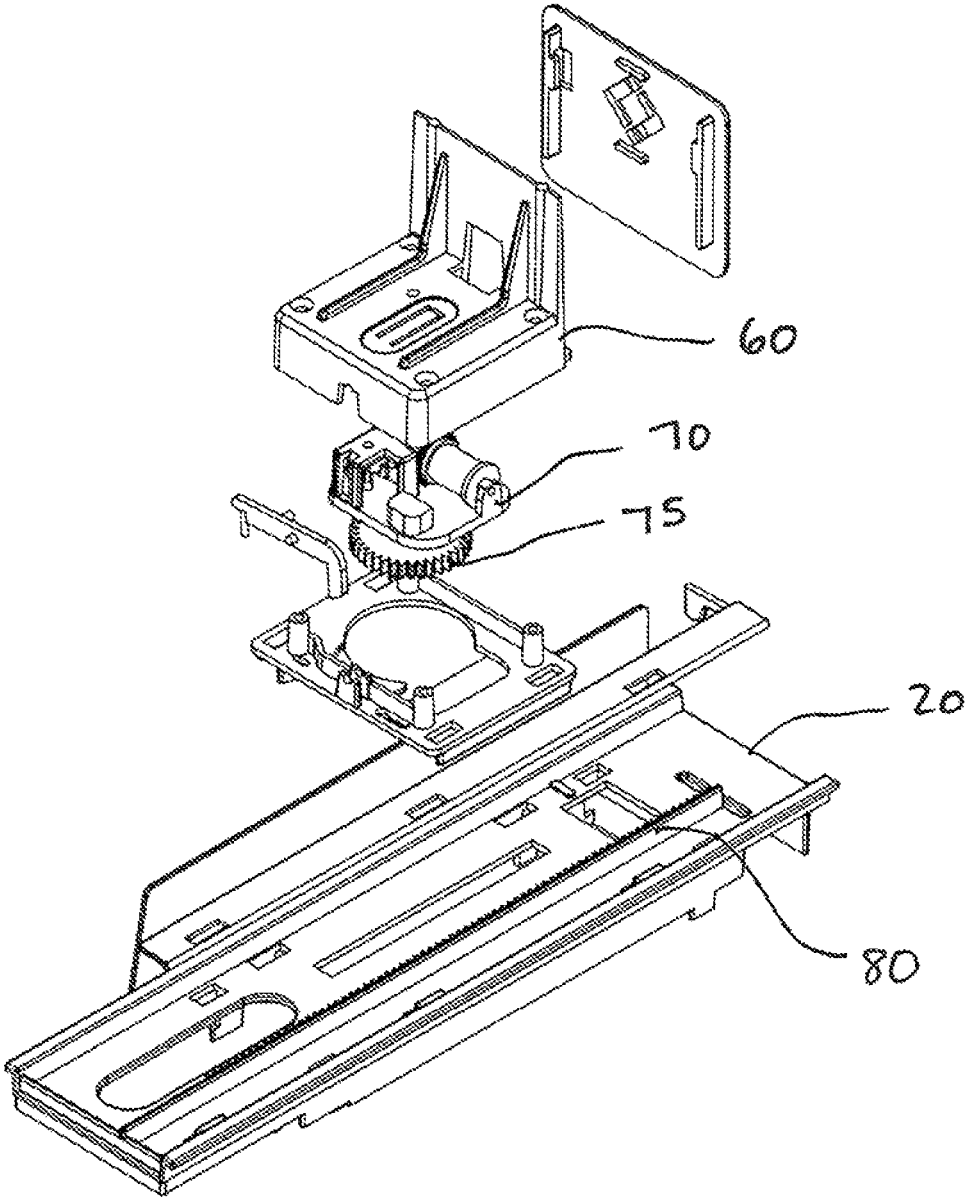
FIG. 8 shows an exploded perspective view of a tray assembly according to one embodiment of the invention.
Figure 9:
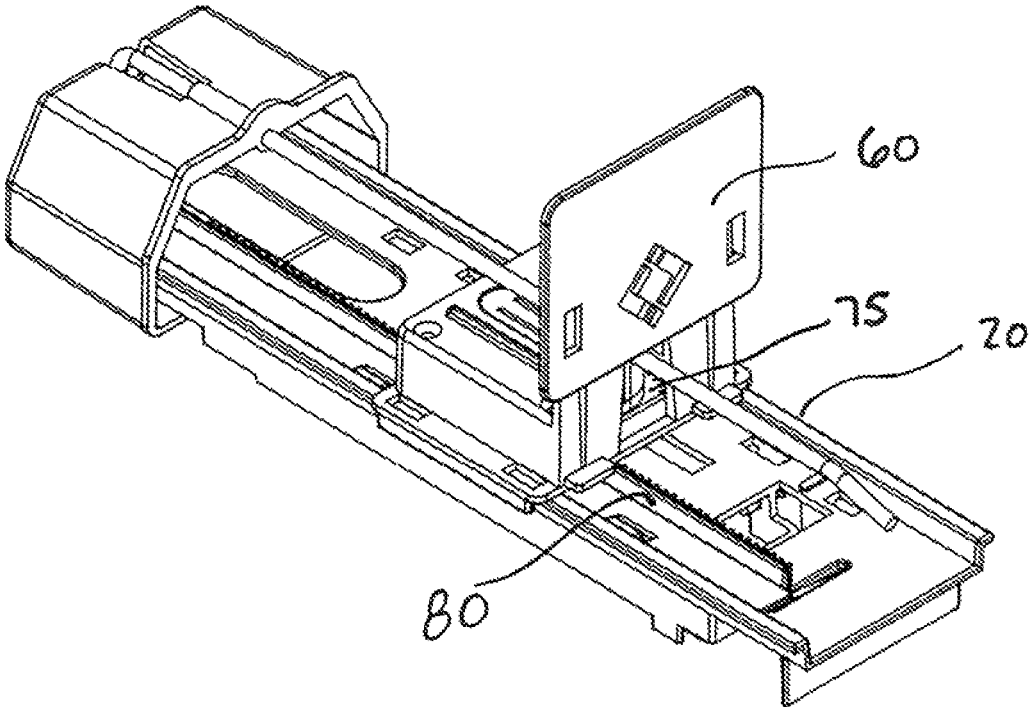
FIG. 9 shows a front perspective view of a tray assembly according to one embodiment of the invention.
Figure 10:
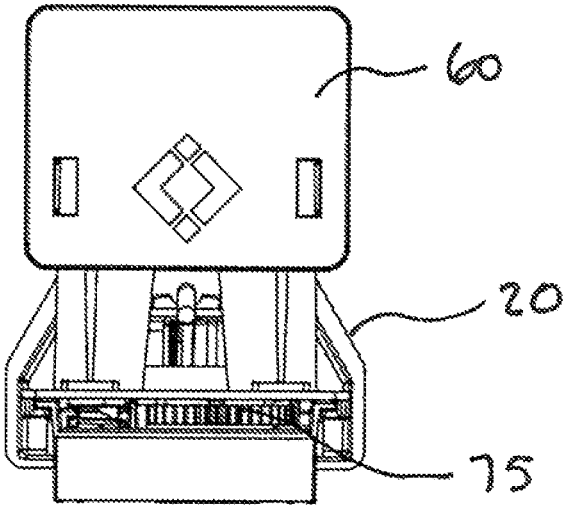
FIG. 10 shows a front view of the tray assembly shown in FIG. 9.

FIGS. 8-10 show an assembly for the tray 20 according to one preferred embodiment. Each tray 20 preferably includes a dedicated motor 70 connected with respect to a pusher 60 along a track 80. A drivewheel 75 within the motor 70 preferably urges the pusher 60 forward along the track 80 when actuated and thereby urges product forward along the tray 20 and ultimately forward off the tray 20 and into an output tray 120 for recovery by the customer. The motor 70 is preferably spring-wound and may be rewound by operation of loading the respective tray 20. In this manner, when additional restocked product is placed within the tray 20 and the pusher 60 slides backward, the drivewheel 75 winds the motor as it retracts along the track 80. As such, the product dispensing system 10 preferably does not require power and is perpetually self-powered by virtue of keeping and maintaining stock within the trays 20.

Figure 11:
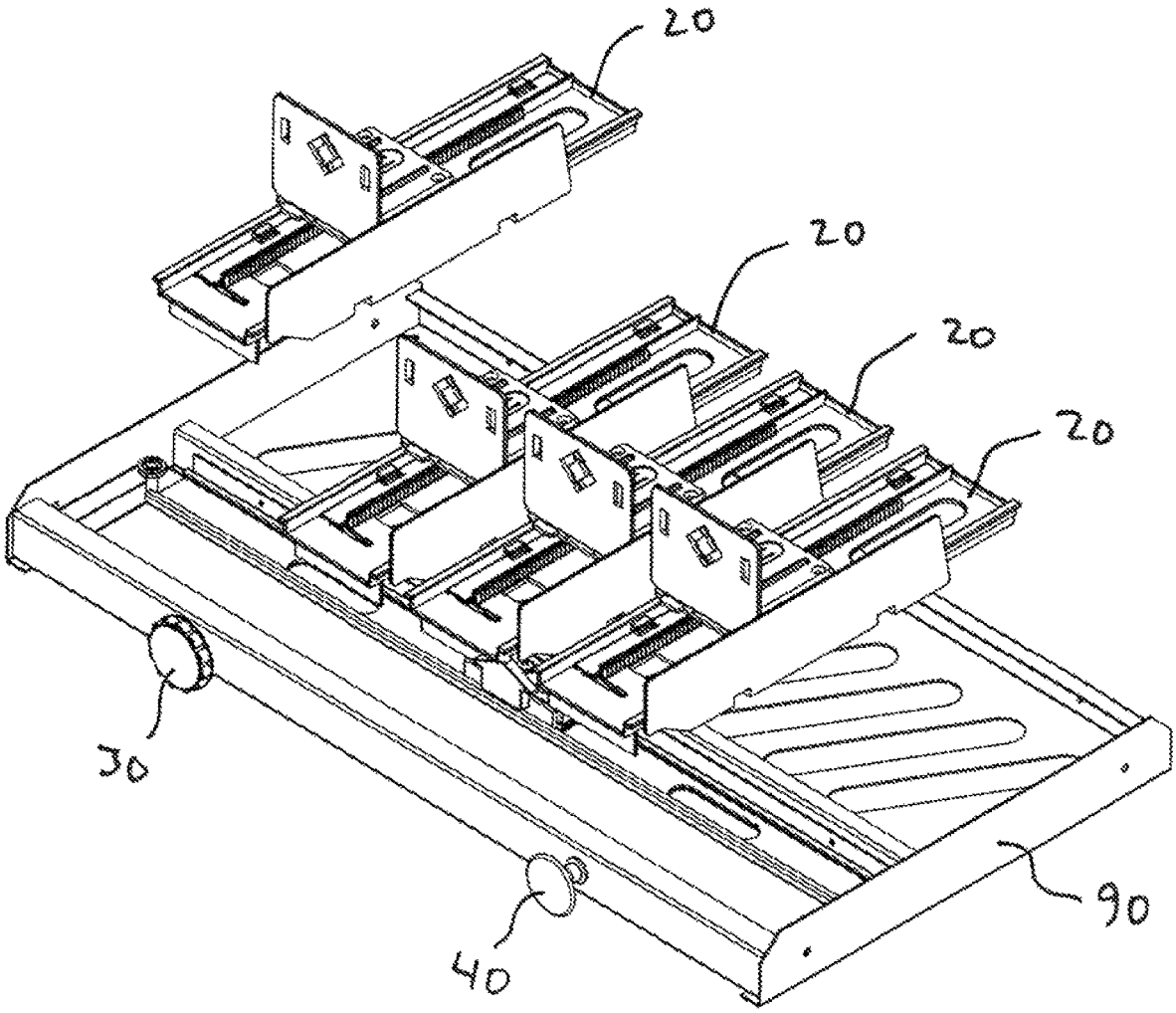
FIG. 11 shows a front perspective view of a plurality of trays in the product dispensing system according to one embodiment of the invention.
Figure 12:
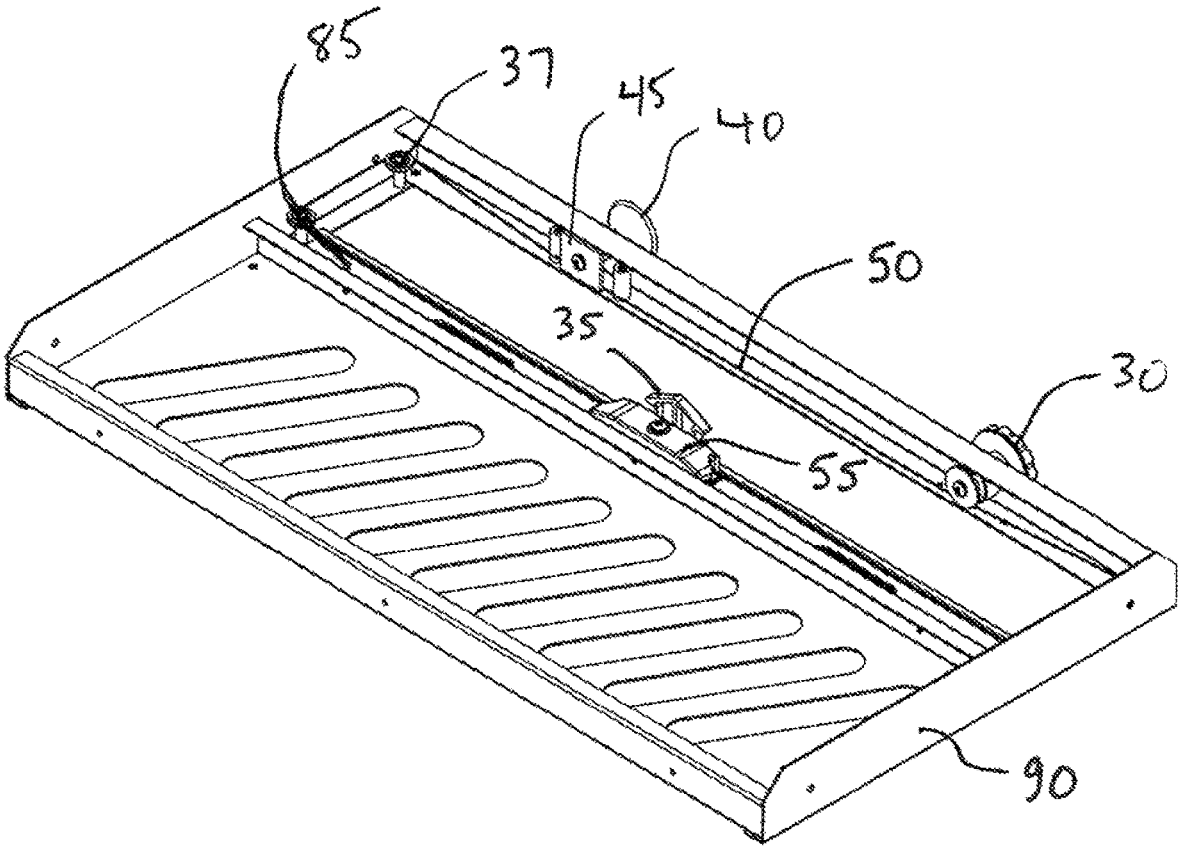
FIG. 12 shows a selector frame of the product dispensing system according to one embodiment of the invention.

FIGS. 11 and 12 show a selector 30 and knob 40 assembly according to one preferred embodiment. The selector 30 and knob 40 are separately positioned and each preferably tethered to the cable 50—the selector 30 preferably includes an integrated pulley 37 and the knob 40 preferably includes a pull plate 45 that is positioned along the cable 50. The pull plate 45 is configured so that as the knob 40 is pulled outward a tension is applied to the cable 50 thereby actuating the selected tray 20 and respective motor 70. Alternatively, as shown in FIG. 13, the knob 40 may include a groove through which the cable 50 passes such that when the knob 40 is rotated, the cable 50 is tightened thereby engaging the lifter carriage 55 with the tray 20.

FIGS. 11 and 12 also show the rigid frame 90 that serves as the base for the housing 100. The frame 90 accommodates the selector 30 and the knob 40 as well as the cable 50 assembly including pulleys 37 and lifter carriage 55. In addition, as shown in FIG. 12, the lifter carriage 55 travels within a lift bar 85 which is configured to respond to the tension applied to the cable 50 by the pull knob 40 and dispense the product from a respective tray 20.

FIG. 12 shows an arrangement wherein the knob 40 is used to position the lifter carriage 55 and, once in place, the selector 40 is depressed to engage the pull plate 45 and thus tighten the cable 50. Once tightened, the cable 50 lifts the lifter carriage 55 to engage the motor 70 on the respective selected tray 20, either directly or indirectly.

Figure 13:
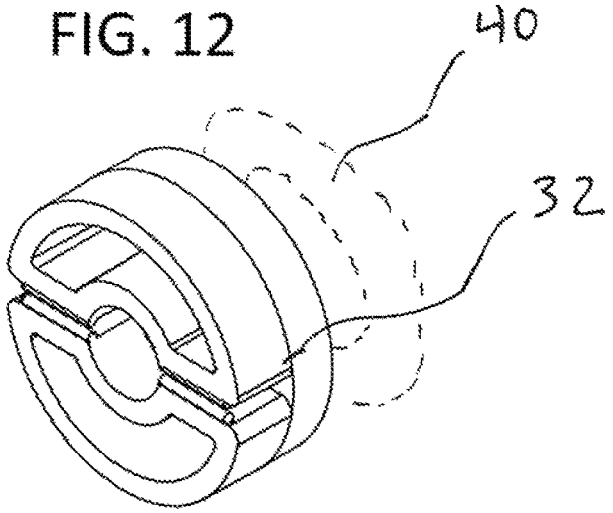
FIG. 13 shows a perspective view of a knob wheel according to one embodiment of the invention.
Figure 14:
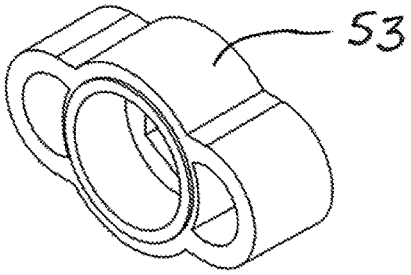
FIG. 14 shows a perspective view of a mechanical stop according to one embodiment of the invention.
Figure 15:
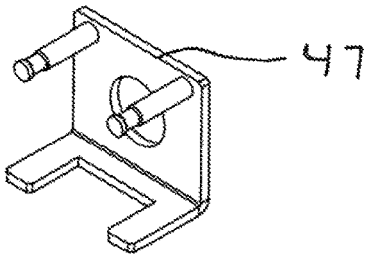
FIG. 15 shows a perspective view of a tensioner according to one embodiment of the invention.
Figure 16:
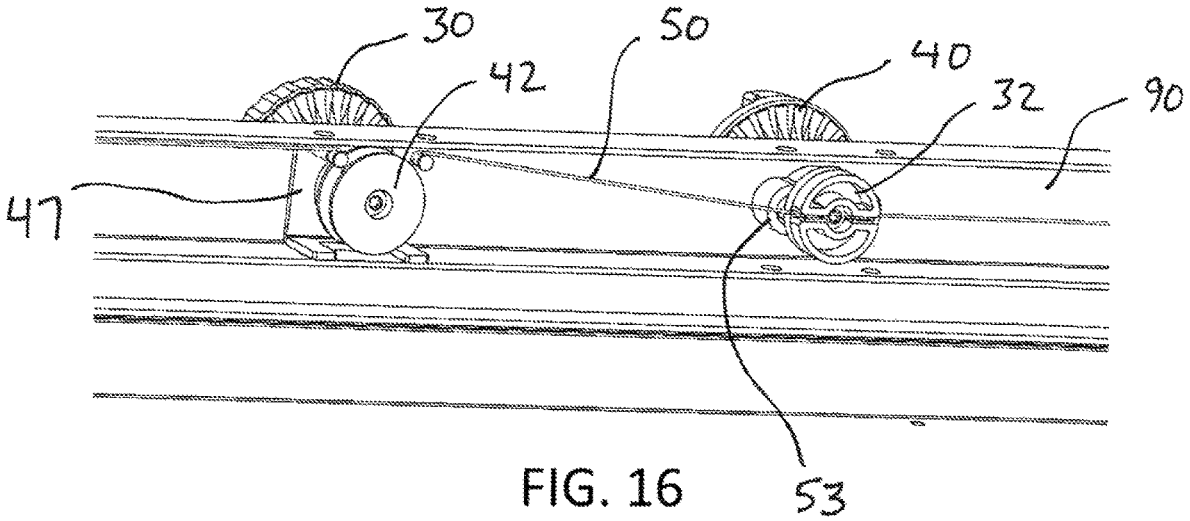
FIG. 16 shows a perspective view of a portion of product dispensing system according to one preferred embodiment of the invention.

FIG. 13-16 show an alternative arrangement that includes a cable wheel 32 shown in FIG. 13, a mechanical stop shown in FIG. 14, and a tensioner 47 shown in FIG. 15. The cable wheel 32 is preferably connected with the knob 40 and may further include the mechanical stop 53. FIG. 16 shows this arrangement wherein the knob 40 is used to position the lifter carriage (not shown) and, once in place, the selector 40 is rotated to thereby rotate a cable wheel 32, having the cable traversing through it, and thus tighten the cable 50. The selector 30 is preferably positioned through a tensioner 47 as shown in FIG. 15 and may further include a selector pulley 42 around which the cable 50 is wrapped in concert with the tensioner 47. The selector pulley 42 and tensioner 47 are preferably arranged as shown in FIG. 16 to minimize cable 50 movement and/or the opportunity for the cable 50 to become untracked from the system.

In the arrangement shown in FIG. 16, the mechanical stop 53 is positioned to limit over rotation of the knob 40 and prevent damage or stretching to the cable 50. The mechanical stop 53 may contact edges of the frame 90 as shown in FIG. 16 to prevent such over-rotation. Once appropriately tightened, the cable 50 lifts the lifter carriage 55 to engage the motor 70 on the respective selected tray 20, either directly or indirectly, as described above. As shown in FIGS. 13, 14 and 16, the knob 40 and mechanical stop 53 and cable wheel 32 are arranged in a rotatable embodiment that may include integrated stops to limit rotation in both directions. In this manner, like other features of the product dispensing system 10, abusive use of the system 10 is limited because controls do not have a long travel and are not susceptible to violent repetitive motions or actions that may destroy the functionality of the system 10. Alternatively, the knob 40 is configured to pull and thereby tighten the cable 50 to actuate the respective tray. Likewise, in this embodiment, the knob 40 preferably includes an integrated stop to limit outward travel.

In addition to the security benefits inherent in the system 10 described above, the product dispensing system 10 may further include an audible and/or visual alarm 140 or signal connected with respect to one of the selector 30, the knob 40, and the lifter carriage 55. The audible and/or visual alarm may be self-contained within the product dispensing system 10 or may include a wireless transmission feature such that the alarm is transmitted directly to a store employee, either onsite or remote. In addition, or alternatively, the actuation of the motor 70 may produce audible and/or visual feedback. In addition, or alternatively, a product landing on the output tray may trigger an audible and/or visual alarm 140 or signal. In this way, only the actual dispensing of a product or products will trigger the alarm 140 or signal.

While in the foregoing detailed description the subject development has been described in relation to certain preferred embodiments thereof, and many details have been set forth for purposes of illustration, it will be apparent to those skilled in the art that the subject development is susceptible to additional embodiments and that certain of the details described herein can be varied considerably without departing from the basic principles of the invention.

We claim:

1. A product dispensing system comprising:

a housing having lockable access, a forward viewing window and a lower output tray;

two or more trays positioned within the housing, each tray of the trays accommodating a plurality of products, wherein each tray includes a self-contained motor and track configured to move the products responsive to a user action;

a selector for moving an indicator laterally between the two or more trays;

a knob spaced apart from the selector, the knob activating the motor to move the products forward and drop a single product into the output tray, wherein the selector and the knob are arranged along a cable wherein, once the knob is actuated, the cable tightens and actuates a lifter carriage to engage a respective tray to dispense the single product.

2. The product dispensing system of claim 1 comprising two or more levels of products wherein two or more trays are arranged along each of the two or more levels of products.

3. The product dispensing system of claim 2 wherein each level includes a dedicated selector and knob for dispensing product on the output tray.

4. The product dispensing system of claim 2 comprising an upper level and a lower level wherein product on the upper level hangs from a peghook and product on the lower level rests on a tray.

5. The product dispensing system of claim 3 wherein the selector and knob are in a reverse position on an upper level from a lower level.

6. The product dispensing system of claim 1 wherein the knob is configured to rotate and thereby tighten the cable to actuate the respective tray.

7. The product dispensing system of claim 6 wherein the knob includes integrated stops to limit rotation in both directions.

8. The product dispensing system of claim 1 wherein the knob is configured to pull and thereby tighten the cable to actuate the respective tray.

9. The product dispensing system of claim 8 wherein the knob includes an integrated stop to limit outward travel.

10. The product dispensing system of claim 1 wherein the motor comprises a spring wound motor that is operatively connected to a pusher on a respective tray wherein an action of restocking product in the tray moves the pusher and winds the motor.

11. The product dispensing system of claim 10 wherein each tray includes a drive wheel and a track operatively connected between the motor and the tray.

12. The product dispensing system of claim 1 wherein the actuation of the motor produces audible and/or visual feedback.

13. A product dispensing system comprising:

a housing having lockable access, a forward viewing window and a lower output tray;

two or more trays positioned within the housing, each tray of the trays accommodating a plurality of products, wherein each tray includes a self-contained motor and track configured to move the products responsive to a user action;

a selector for moving an indicator laterally between the two or more trays, wherein the selector is rotatable to move the indicator along a cable and position a lifter carriage in front of a desired tray; and a knob spaced apart from the selector, the knob activating the motor to move the products forward and drop a single product into the output tray.

14. The product dispensing system of claim 1 further comprising a clear cover over the output tray.

15. The product dispensing system of claim 1 further comprising an audible and/or visual alarm connected with respect to one of the selector, the knob, and the lifter carriage.

16. The product dispensing system of claim 15 wherein the alarm is transmitted directly to a store employee.

17. The product dispensing system of claim 13 wherein the selector and the knob are arranged along a cable wherein, once the knob is actuated, the cable tightens and actuates a lifter carriage to engage a respective tray to dispense the single product.

18. A product dispensing system comprising:

a housing having lockable access, a forward viewing window and a lower output tray;

two or more trays positioned within the housing, each tray of the trays accommodating a plurality of products, wherein each tray includes a self-contained motor and track configured to move the products responsive to a user action;

a frame positioned along a base of the housing;

a selector connected to the frame for moving an indicator laterally between the two or more trays;

a knob connected to the frame and spaced apart from the selector; and a cable threaded between the selector and the knob, the knob rotatable to tighten the cable and activate the motor to move the products forward and drop a single product into the output tray.

19. The product dispensing system of claim 18 further comprising a cable wheel and a mechanical stop connected with respect to the knob wherein the cable is threaded through the cable wheel.

20. The product dispensing system of claim 19 further comprising a selector pulley and a tensioner connected with respect to the selector wherein the cable is threaded through the tensioner and the selector pulley.

* * * * *